US005867983A

United States Patent [19]

Otani

[11] Patent Number: 5,867,983

[45] Date of Patent: Feb. 9, 1999

[54] CONTROL SYSTEM FOR INTERNAL COMBUSTION ENGINE WITH ENHANCEMENT OF PURIFICATION PERFORMANCE OF CATALYTIC CONVERTER

[75] Inventor: Asahiko Otani, Mito, Japan

[73] Assignee: Hitachi, Ltd., Japan

[21] Appl. No.: 735,984

[22] Filed: Oct. 25, 1996

[30] Foreign Application Priority Data

Nov. 2, 1995 [JP] Japan ..... 7-285640

[51] Int. Cl.[6] ..... F02D 43/04; F02D 41/14

[52] U.S. Cl. ..... 60/276; 60/285; 123/406.23; 123/406.44; 123/696

[58] Field of Search ..... 123/406, 417, 123/419, 679, 696; 60/276, 277, 285

[56] References Cited

U.S. PATENT DOCUMENTS

| | | | |
|---|---|---|---|
| 5,099,818 | 3/1992 | Takahashi et al. | 123/696 X |
| 5,148,791 | 9/1992 | Nagano et al. | 123/417 |
| 5,363,091 | 11/1994 | Kotwicki et al. | 60/276 X |
| 5,363,648 | 11/1994 | Akazaki et al. | 123/703 X |
| 5,383,432 | 1/1995 | Cullen et al. | 123/406 |
| 5,448,975 | 9/1995 | Sato | 123/406 X |
| 5,609,023 | 3/1997 | Katoh et al. | 60/276 |
| 5,678,402 | 10/1997 | Kitagawa et al. | 60/285 X |

FOREIGN PATENT DOCUMENTS

| | | |
|---|---|---|
| 62-203946 | 9/1987 | Japan . |
| 2-271046 | 11/1990 | Japan . |
| 6-200802 | 7/1994 | Japan . |

OTHER PUBLICATIONS

Bosch Kraftfahrttechnisches Taschenbuch, 22nd Edition, pp. 473 to 483.

*Primary Examiner*—Tony M. Argenbright
*Attorney, Agent, or Firm*—Evenson, McKeown, Edwards & Lenahan, P.L.L.C.

[57] ABSTRACT

A control system for an internal combustion engine capable of improving purification performance of a catalytic converter provides an oscillation amplitude for an air/fuel ratio of an air/fuel mixture to be supplied to an internal combustion engine. The air/fuel ratio oscillation amplitude is variable depending upon an operating condition of the internal combustion engine and/or a purification performance of a catalytic converter. Corresponding to the air/fuel ratio oscillation, an oscillation amplitude of a spark ignition timing is provided. The spark ignition timing oscillation amplitude is variable depending upon the operating condition of the internal combustion engine and/or the air/fuel ratio oscillation amplitude.

11 Claims, 7 Drawing Sheets

CONTROL SYSTEM FOR INTERNAL COMBUSTION ENGINE WITH ENHANCEMENT OF PURIFICATION PERFORMANCE OF CATALYTIC CONVERTER

BACKGROUND OF THE INVENTION

The present invention relates generally to a control system for an internal combustion engine. More specifically, the invention relates to a control system for an internal combustion engine which can attain ultimate purification performance of a catalytic converter and prevent degradation of drivablity of a vehicle or so forth.

In viewpoint of environment protection, restriction for various components in an automotive exhaust gas is getting more and more strict. In response to this, variety of means for efficiently purifying the exhaust gas have been proposed. Particularly, when the exhaust gas is purified by means of a catalytic converter, it is an important problem how to maximize purifying action of the catalytic converter. In the prior art, such as JP-A-62-203946 and JP-A-2-271046, there has been proposed means utilizing a phenomenon of improving purification rate of the catalytic converter by varying an air/fuel ratio across a stoichiometric air/fuel ratio.

Morcover, JP-A-200802 has proposed an apparatus for adjusting a deviation of air/fuel ratio in accordance with an operation condition of vehicles and a deterioration of catalyt.

On the other hand, in order to utilize the foregoing phenomenon, the foregoing prior arts take a measure to provide fine oscillation of a fuel supply amount to the internal combustion engine. However, as shown in FIGS. 7 and 9, while there are an oscillation amplitude and an oscillation period suitable for improving purification rate of the catalytic converter in such fine oscillation, it inherently cause fluctuation of a torque generated by the internal combustion engine. Therefore, so as not to sacrifice drivability, application of ideal oscillation period and oscillation amplitude for the catalytic converter has to be given up. Also, under a condition where the catalytic converter is not sufficiently activated or purification performance of the catalytic converter is degraded, if the oscillation period and the oscillation amplitude of the fuel supply amount suitable in the condition where the catalytic converter can act with sufficient purification performance, the catalytic converter may not completely purify the exhaust gas to make the composition of the exhaust gas worse.

SUMMARY OF THE INVENTION

The present invention has been worked out in view of the problems set forth above. Therefore, it is an object of the present invention to provide a control system for an internal combustion engine which can attain ultimate purification performance of a catalytic converter and prevent degradation of drivablity of a vehicle or so forth.

In order to accomplish the above-mentioned object, a control system for an internal combustion engine, according to the present invention, comprises a catalytic converter for purifying an exhaust gas of an internal combustion engine, internal combustion engine operating condition detecting means for detecting operating condition of the internal combustion engine, internal combustion engine control means for controlling an air/fuel ratio of an air/fuel mixture to be supplied to the internal combustion engine or a delivered engine torque of the internal combustion engine depending upon the operating condition, trigger signal generating means for generating a trigger signal for varying the air/fuel ratio toward rich side or lean side, air/fuel ratio adjusting means responsive to the trigger signal for varying the air/fuel ratio toward rich side or lean side, the delivered engine torque being corrected on the basis of the trigger signal for maximizing purifying operation of the catalytic converter with restricting a torque fluctuation.

On the other hand, the internal combustion engine control system may further comprise purification performance detecting means for detecting current condition of an exhaust gas purification performance of the catalytic converter, and variation amplitude of the air/fuel ratio by the air/fuel ratio adjusting means is varied on the basis of the operating condition of the internal combustion engine or in a result of detection of the purification performance. Thus, irrespective of the operating condition of the internal combustion engine, control depending upon purification performance of the catalytic converter can be performed even when the catalytic converter is not in active state or is in fatigue condition.

Also, the trigger signal is generated per every given time interval, and which further comprises torque correcting direction determining means for determining a correcting direction of torque to reduce the delivered engine torque when the air/fuel ratio is to be varied toward rich side and to increase the delivered engine torque when the air/fuel ratio is to be varied toward lean side for performing torque correction in a direction based on the result of determination. A generation time interval of the trigger signal is variable depending upon the operating condition of the internal combustion engine or the result of detection of purification performance of the catalytic converter.

Furthermore, the internal combustion engine control system may comprise an air/fuel ratio sensor provided upstream of the catalytic converter and detecting the air/fuel ration from an exhaust gas component, air/fuel ratio control means for controlling the air/fuel ratio of the air/fuel mixture to be supplied to the internal combustion engine toward a target value depending upon an output signal of the air/fuel ratio sensor, rich/lean judgement means for comparing the air/fuel ratio of the supplied air/fuel mixture with a predetermined value and making judgement whether the air/fuel ratio of the supplied air/fuel mixture is rich or lean, the trigger signal is generated when the result of judgement is reversed from rich to lean or from lean to rich, and which may further comprise torque correcting direction determining means for determining torque correcting direction for increasing the delivered torque with respect to the trigger signal when the result of judgement is reversed from rich to lean and for reducing the delivered torque with respect to the trigger signal when the result of judgement is reversed from lean to rich, and the torque correction is performed in the direction based on the result of determination.

The internal combustion engine control system may further comprise torque correcting amount determining means for determining a torque correcting amount on the basis of the operating condition of the internal combustion engine or an air/fuel ratio variation amplitude by the air/fuel ratio adjusting means, and a torque correction amount in the torque correction is variable depending upon the result of determination. The internal combustion engine control system may further comprise a torque correction amount control means being applied the torque correcting amount determined by the torque correcting amount determining means as initial value of a torque correction amount at initial stage of generation of the trigger signal, for subsequently controlling the torque correcting amount so that it is gradually reduced, and the torque correction is performed on the basis of the result of control.

Also, the internal combustion engine control system may further comprise trigger signal interval measuring means for measuring an interval of generation of the trigger signals, and a reduction speed of the correction amount of the torque correction is variable depending upon one of the operating condition of the internal combustion engine and the generation interval of the trigger signal measured by the trigger signal interval measuring means. The internal combustion engine control system may further comprise a delay period setting means for setting a predetermined delay period from the trigger signal to initiation of the torque correction, and the torque correction is initiated on the basis of the delay period the by the delay period setting means.

The delay period may be variable depending upon the operating condition of the internal combustion engine. The correction of delivered engine torque of the internal combustion engine may be performed by adjusting one of a spark ignition timing, a fuel injection timing, an EGR flow rate, an intake air flow rate, an intake air flow strength, a fuel particle diameter, an intake or exhaust valve timing, an intake valve lift, an induction passage length and an engine load.

The internal combustion engine operating condition detecting means in the internal combustion engine control system according to the present invention, which is constructed as set forth above, is adapted to detect a revolution speed, a load, a coolant temperature, a throttle open angle of the internal combustion engine or variation degree thereof, and the internal combustion engine control means controls a fuel supply amount, an intake air flow rate, the air/fuel ratio of a supply mixture, the spark ignition timing, the fuel injection timing, the EGR flow rate, the intake air flow strength, the fuel particle diameter, the intake or exhaust valve timing, the intake valve lift, the induction passage length, the engine load or so forth.

The trigger signal generating means is adapted to generate the trigger signal for varying the air/fuel ratio of the air/fuel mixture to be supplied to the internal combustion engine toward rich side or lean side, makes judgement whether the trigger signal is to be generated or not on the basis of the operating condition of the internal combustion engine. When the trigger signal is to be generated, the trigger signal is generated by itself or in response to an external signal. The purification performance detecting means detects the activating condition of the catalytic converter or degradation degree of exhaust gas purification performance of the catalytic converter.

The air/fuel ratio sensor is designed for detecting the air/fuel ratio on the basis of the composition of the exhaust gas. The air/fuel ratio control means controls the fuel supply amount and/or the intake air flow rate to control the air/fuel ratio of the mixture to be supplied to the internal combustion engine toward a target air/fuel ratio depending upon the result of detection by the air/fuel ratio detecting means.

DESCRIPTION OF THE PREFERRED EMBODIMENT

Preferred embodiments of the present invention will be discussed hereinafter in detail with reference to the drawings.

Figure 1:
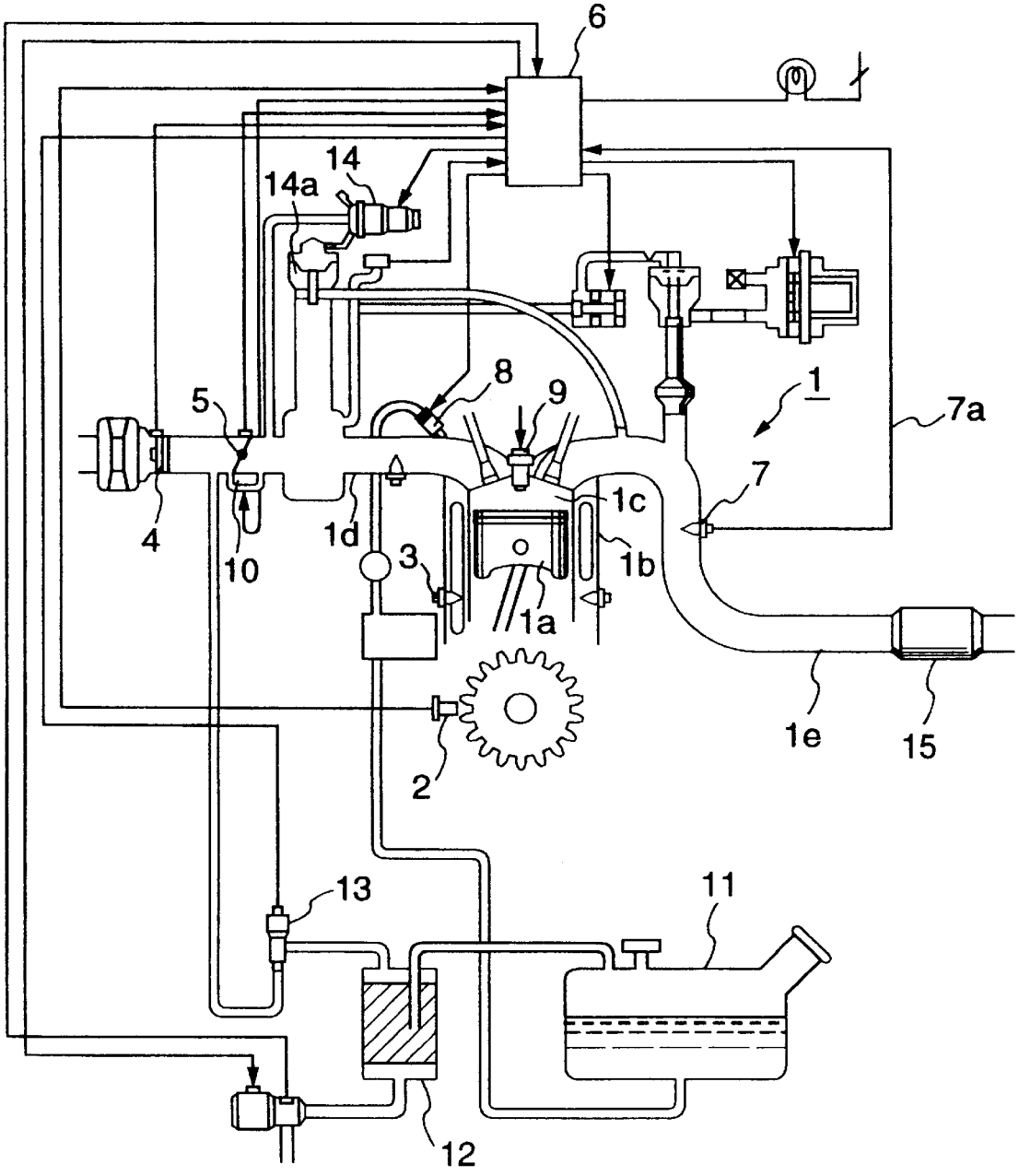
FIG. 1 is a diagrammatic illustration showing general construction of an internal combustion engine with one embodiment of an internal combustion engine control system according to the present invention.

FIG. 1 shows the overall construction of the preferred embodiment of an internal combustion engine and a control system for the internal combustion engine.

In a cylinder of the internal combustion engine 1, a combustion chamber 1*c* is defined by a piston 1*a* and a cylinder 1*b*. To the upper portion of the combustion chamber 1*c*, an induction passage 1*d* and an exhaust passage 1*e* are connected.

In the induction passage 1*d*, a fuel injector 8 for injecting a fuel supplied from a fuel supply system including a fuel tank 11, a canister 12, a surge control valve and so forth, an idling air flow rate adjusting valve 10 and so forth are arranged. Within the combustion chamber 1*c*, a spark ignition plug 9 is disposed. On the other hand, in the exhaust passage 1*e*, a catalytic converter unit 15 is provided. Also, between the induction passage 1*d* and the exhaust passage 1*e*, an EGR mechanical including an EGR solenoid valve, an exhaust gas recirculation valve 14*a* or so forth is disposed.

In the internal combustion engine 1, an engine speed sensor 2, an engine coolant temperature sensor 3, an intake air flow rate sensor 4 and a throttle angle sensor 5, serving as detecting means for detecting an operating condition of the internal combustion engine, are arranged. Also, an air/fuel ratio sensor 7 for detecting an air/fuel ratio of an air/fuel mixture to be introduced into the internal combustion engine 1 is arranged in the exhaust passage 1.

A control system 6 receives detection signals from the internal combustion engine operating condition detecting means constituted of various detection sensors, and controls a fuel injector 8, a spark ignition coil (not shown), the spark ignition plug 9, the idling air flow rate adjusting valve 10 and so forth.

The control system 6 is constructed with internal combustion engine control means, trigger signal generating means, air/fuel ratio adjusting means, purification performance detecting means, air/fuel ratio control means and rich/lean judgement means and so forth, as be discussed later.

Figure 2:
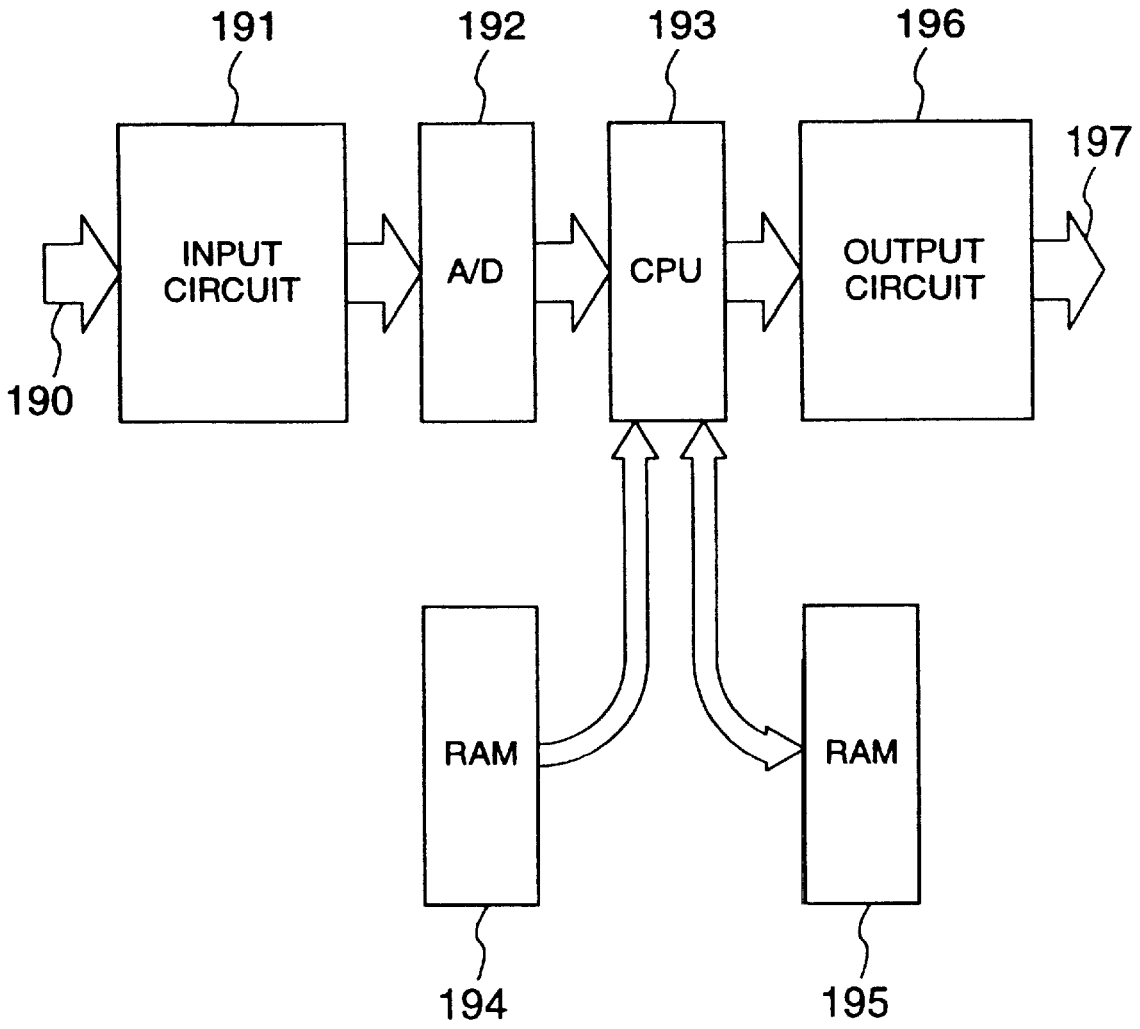
FIG. 2 is a schematic block diagram showing a construction of a computer of one embodiment of the internal combustion engine control system.

As shown in FIG. 2, the control system 6 is constructed with an input circuit 191, an A/D converter portion 192, a central arithmetic unit 193, a ROM 194, a RAM 195 and an output circuit 196. The input circuit 190 receives input signals(signals from the engine coolant temperature sensor 3, the intake air flow rate sensor 4, the throttle angle sensor 5 and the air/fuel ratio sensor 7 and so forth, for example), performs elimination of noise component from the received signals and output to the A/D converter portion 192. The A/D converter portion 192 performs A/D conversion for the signals and outputs the converted signals to the central arithmetic unit 193. The central arithmetic unit 193 receives the results of A/D conversion and performs various control and diagnosis by executing predetermined programs stored in the ROM 194.

It should be noted that results of arithmetic operation and results of A/D convention are temporarily stored in the RAM 195. Also, the results of arithmetic operation are output as control output signals via the output circuit 196 for controlling the fuel injector 8 and so forth. It should be further noted that the construction of the control system 6 is not limited to the shown construction.

Figure 3:
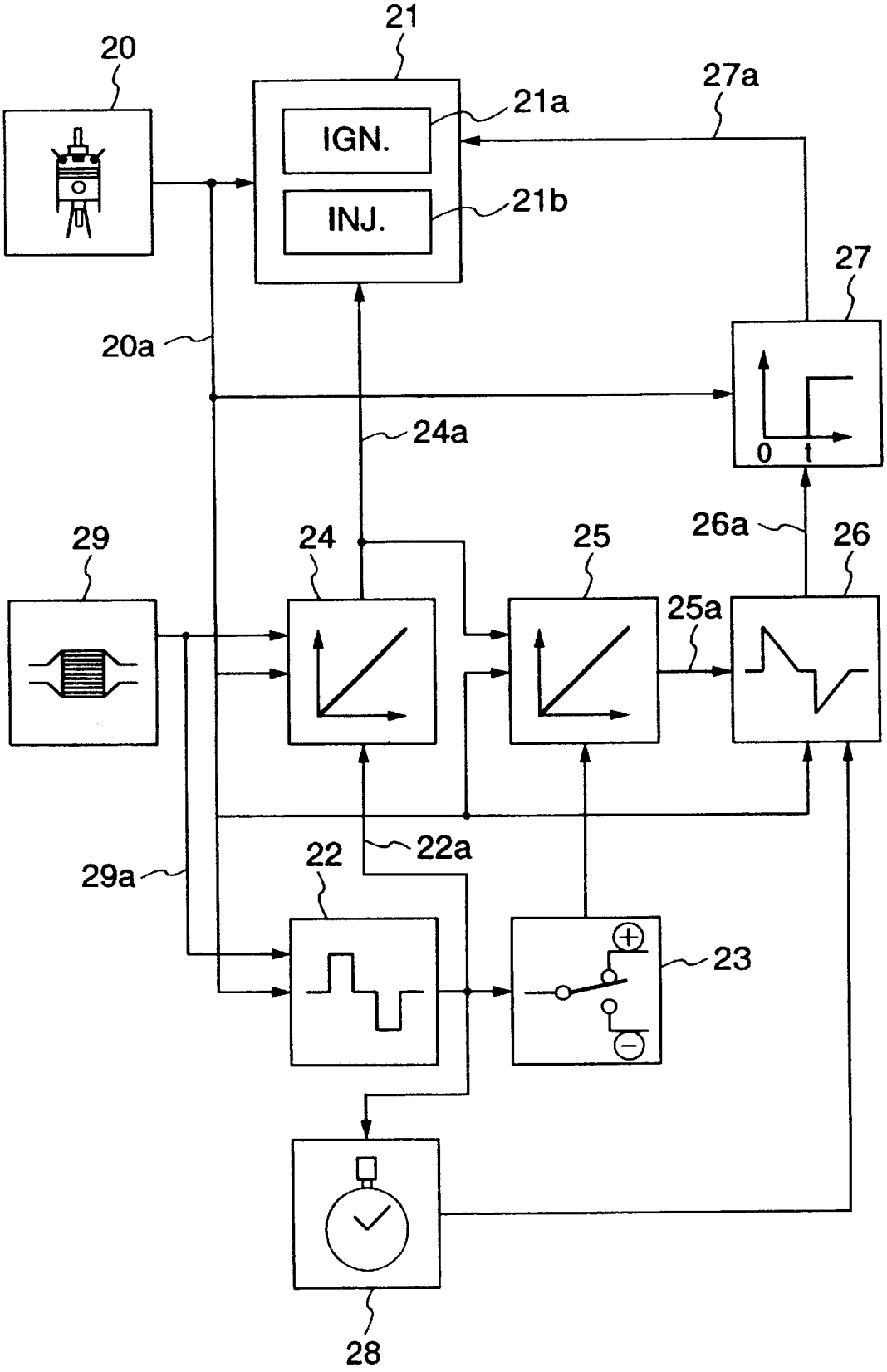
FIG. 3 is a block diagram showing a general function of one embodiment of the internal combustion engine control system.

FIG. 3 shows a construction of control function of the shown embodiment of the control system.

Various operating condition indicative information 20*a* of the internal combustion engine 1 obtained in the internal combustion engine operating condition detecting means 20, is fed to the internal combustion engine control means 21. Then, operating condition of the internal combustion engine 1 is performed by performing control by the spark ignition timing control means 21*a* and the fuel injection control means 21*b* depending upon the operating condition indicative information 20*a*.

On the other hand, the operating condition indicative information 20*a* is fed to the trigger signal generating means 22 to be used for judgement whether a trigger signal 22*a* is to be generated or not. For instance, judgement whether the trigger signal 22*a* can be generated or not is performed by checking whether an engine coolant temperature indicative signal of the engine coolant temperature sensor 3 indicates an engine coolant temperature higher than or equal to a predetermined engine coolant temperature, whether an engine speed signal of the engine speed sensor 2 indicates an engine speed higher than or equal to a predetermined speed, or whether an exhaust temperature indicative signal of an exhaust temperature sensor (not shown) indicative an exhaust temperature higher than or equal to a predetermined exhaust temperature. If judgement is made that the trigger signal 22*a* can be generated, a time interval of generation of the trigger signal is determined depending upon the operating condition indicative information 20*a* and a purification performance detection information 29*a* of the catalytic converter purification performance detecting means 29. On the basis of such decision, the trigger signal 22*a* is generated. It should be noted that when the a purification performance detection information 29*a* represents degradation of the catalytic converter unit 15 beyond a predetermined extent, generation of the trigger signal 22*a* per se can be stopped.

The catalytic converter purification performance detecting means 29 can be realized by making judgement whether the catalytic converter is active or not depending upon the signal of the exhaust temperature sensor, or by obtaining degree of degradation of the catalytic converter from number of times of reversal of output during air/fuel ratio control on the basis of signal from the air/fuel ratio sensor (not shown) provided at downstream of the catalytic converter unit 15. However, the manner of realization of the catalytic converter purification performance detecting means 29 is not limited to these.

Amplitude of oscillation of the air/fuel ratio of an air/fuel mixture to be supplied to the internal combustion engine 1 applied in synchronism with the generated trigger signal 22*a* is determined by the air/fuel ratio adjusting means 24. The air/fuel ratio adjusting means 24 determines the air/fuel ratio of the supply mixture to the internal combustion engine 1 on the basis of the a purification performance detection information 29*a* and the operating condition indicative information 20*a*.

An air/fuel ratio oscillation amplitude signal 24*a* synchronized with the trigger signal 22*a* determined by the air/fuel ratio adjusting means 24 is fed to the fuel injection control means 21*b* so that the amplitude of oscillation of the air/fuel ratio of the supply mixture to the internal combustion engine is provided on the basis of the air/fuel ratio oscillation amplitude signal 24*a*.

On the other hand, information to vary the air/fuel ratio of the supply mixture toward rich side or lean side by the trigger signal 22*a* is fed to torque correcting direction determining means 23. The torque correcting direction determining means 23 makes judgement to decrease or increase the torque.

In the shown embodiment, discussion will be given for the embodiment to perform torque correction on the basis of difference of the spark ignition timing. However, it is possible to perform torque conversion by employing any one of fuel injection timing, exhaust gas recirculation rate, intake air flow rate, intake air flow strength, fuel particle diameter, intake and exhaust valve timing, intake valve lift, induction passage length, engine load and so forth.

Particularly, concerning fuel injection timing, since spark ignition timing in a diesel engine can be controlled by the fuel injection timing, torque to be generated can be effectively corrected.

Concerning the exhaust gas recirculation rate, the torque to be generated can be corrected by reducing an effective cylinder volume by recirculating an inert gas to the induction side through the exhaust gas recirculation valve 14*a* or by lowering combustion speed.

Concerning intake air flow rate, by adjusting an intake air flow rate by the idling air flow rate adjusting valve 10 or a throttle open angle control actuator (not shown) as replacement thereof, the torque to be generated can be corrected.

Concerning intake air flow strength, by utilizing the fact that combustion speed becomes faster by generating a strong tumble or swirl by a gas flow control actuator (not shown), the torque to be generated can be corrected.

Concerning the fuel particle diameter, the intake air metered by the intake air flow rate sensor 4 is supplied in the vicinity of the injection opening of the fuel injector 8 via an auxiliary air control valve communicated with the auxiliary air passage (not shown) to improve combustion by making atomized particle of fuel smaller. Thus, the torque to be generate can be corrected.

Concerning intake and exhaust valve timing, by adjusting overlap magnitude of the intake and exhaust valves by a variable valve timing mechanism (not shown), the torque to be generated can be corrected. by utilizing the fact that the volume efficiency is varied depending upon magnitude of overlap of the intake and exhaust valves.

Concerning the intake valve lifting, the torque to be generated can corrected. by adjusting the lifting amount of the intake valve by means of a variable valve lifting amount adjusting mechanism (not shown) and by utilizing variation of charging efficiency depending upon large and small of the valve lifting amount. Also, in the engine with a multi-valve mechanism, when the intake valves are selectively opened utilizing the variable valve lifting amount adjusting mechanism, the torque to be generated can be corrected by utilizing the fact that the combustion speed becomes faster by generating strong tumble or swirl with strengthening gas flow.

Concerning the length of the induction passage, the torque to be generated can be corrected utilizing variation of degree of influence of inertial air intake effect by adjusting length of the intake passage by means of the induction passage length adjusting mechanism (not shown).

Concerning the engine load, the torque to be generated can be corrected by controlling the load on the internal combustion engine 1 by controlling a power generation of a generator by a charge system control device (not shown).

On the other hand, in the torque correcting direction determining means 23, judgement whether the spark ignition timing is to be varied in retarding side or advancing side. Retarding or advancing information judged by the torque correcting direction determining means 23 is fed to the torque correction amount determining means 25 in synchronism with the trigger signal. The torque correction amount determining means 25 determines magnitude of retarding or advancing of the spark ignition timing. Here, an initial value of the retarding amount or advancing amount of the spark ignition timing is determined on the basis of the operating condition indicative information 20*a* and the oscillation amplitude of the air/fuel ratio determined by the air/fuel ratio adjusting means 24. An initial value information 25*a* of the retarding amount or advancing amount determined by the torque correction amount determining means 25 is fed to the torque correction amount controlling means 26 to determine how to reduce the retarding amount or the advancing amount from the initial value. In the torque correction amount controlling means 26, a reduction speed is determined depending upon the operating condition indicative information 20*a* and a generation time interval of the trigger signal measured by a trigger signal interval measuring means 28.

Retard or advance signal 26*a* of the spark ignition timing in synchronism with the trigger signal determined as set forth above, is fed to a delay period setting means 27. The delay period setting means 27 determines a delay period on the basis of the operating condition indicative information 20*a* to feed the retard or advance signal 26*a* with the determined delay period to the spark ignition timing control means 21*a* as a spark ignition timing oscillation amplitude signal 27*a*. On the basis of the spark ignition timing oscillation amplitude signal 27*a*, the spark ignition timing of the internal combustion engine 1 is controlled toward retarding side or advancing side.

Figure 4A:
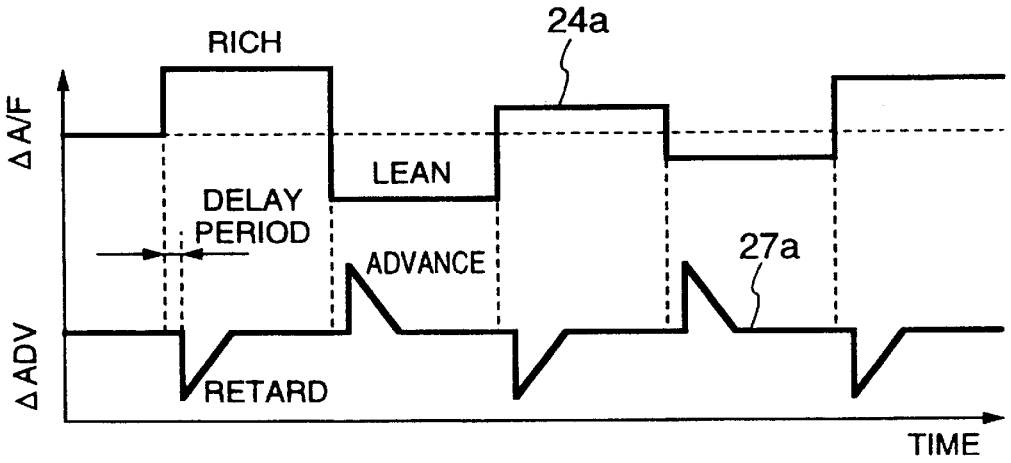
FIGS. 4A and 4B are respectively a waveform chart showing a relationship between an air/fuel ratio oscillation amplitude signal 24*a* and a spark ignition timing oscillation amplitude signal 27*a* of the internal combustion engine control system, and a waveform chart showing a delay time from starting of an air/fuel ratio oscillation amplitude and starting of a spark ignition timing correction.

FIG. 4A shows a relationship between the air/fuel ratio oscillation amplitude signal 24*a* and the delay period setting means 27 of the shown embodiment of the control system shown in FIG. 3.

The air/fuel ratio oscillation amplitude signal 24*a* repeatedly varied between rich and lean at a predetermined period in synchronism with the not shown trigger signal. The oscillation amplitude of the air/fuel ratio oscillation amplitude signal 24*a* is determined by the air/fuel ratio adjusting means 24 on the basis of the purification performance detection information 29*a* and the operating condition indicative information 20*a*. The spark ignition timing oscillation amplitude signal 27*a* is set at the initial value after the predetermined delay period. The initial value is determined on the basis of the operating condition indicative information 20*a* and the oscillation amplitude of the air/fuel ratio determined by the air/fuel ratio adjusting means 24. The spark ignition timing oscillation amplitude signal 27*a* is set by the torque correcting direction determining means 23 in the retarding direction to reduce the torque to be generated when the air/fuel ratio is varied toward rich side and in advancing direction to increase the torque to be generated when the air/fuel ratio is varied toward lean side. The reduction speed of the initial value is determined by the torque correction amount controlling means 26 so that the spark ignition timing subjecting the retarding correction is gradually advanced, and conversely, the spark ignition timing subjecting advancing correction is gradually retarded to make the correction amount zero, finally.

Figure 4B:
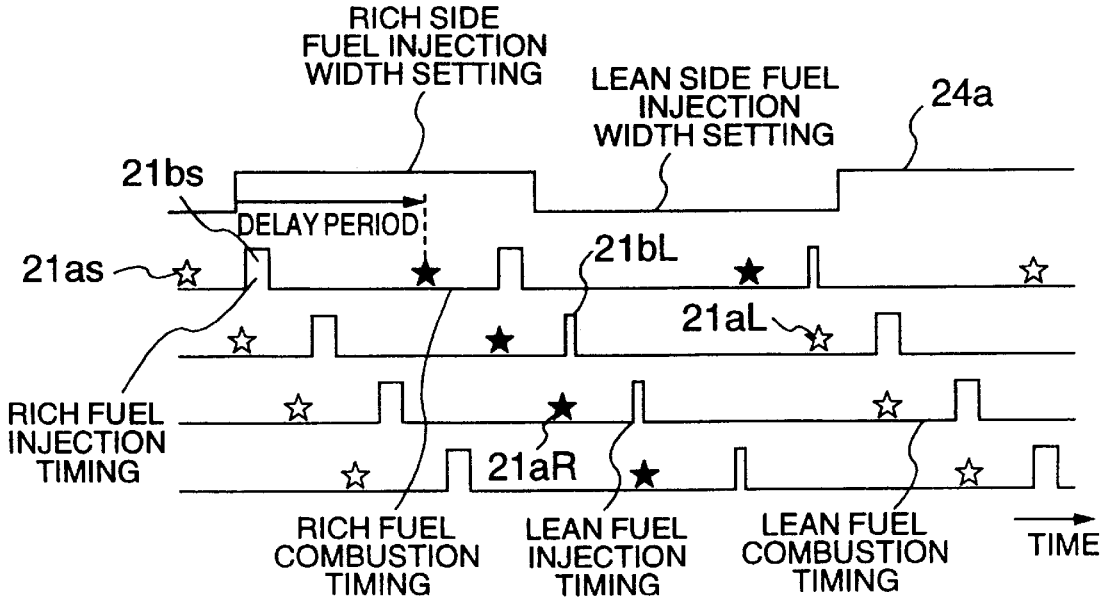

FIG. 4B illustrates a delay period from occurrence of the trigger signal to initiation of the spark ignition timing correction.

Similarly to the above, the air/fuel ratio oscillation amplitude signal 24*a* repeats rich and lean at the predetermined period. A pulse width of a fuel injection pulse 21*bs* is corrected to have greater width or to have smaller width depending upon the air/fuel ratio oscillation amplitude signal 24*a*. On the other hand, the spark ignition timing is corrected for retarding and advancing as set forth above, wherein the leading edge of a spark ignition signal 21*as* is shifted toward left for advancing spark ignition timing and toward right for retarding spark ignition timing, in FIG. 4B.

When the air/fuel ratio is varied toward lean side, outputting of the thinner fuel injection pulse width is started from the timing of 21*b*L. However, when sequential injection is to be performed as shown in FIG. 4B, since the fuel injection pulse is normally output in the exhaust stroke of each cylinder, the fuel injected by the injection pulse 21*b*L is actually compressed and burnt at a timing of 21*a*L. Therefore, application of the corrected spark ignition timing with advancing correction for compensation of the air/fuel ratio varied toward lean side has to be delayed up to the timing of 21*a*L. If advancing correction is effected instantly, advancing correction becomes effective at the timing of 21*a*R. However, at the timing of 21*a*R, since spark ignition has to be performed for rich fuel injected at immediately preceding injection timing, therefore, spark advance has to be retarded conversely. As set forth above, by providing delay in initiation of correction of the spark ignition timing, correction for the air/fuel ratio and correction for the spark ignition timing can be synchronized at the combustion stroke.

Figure 5:
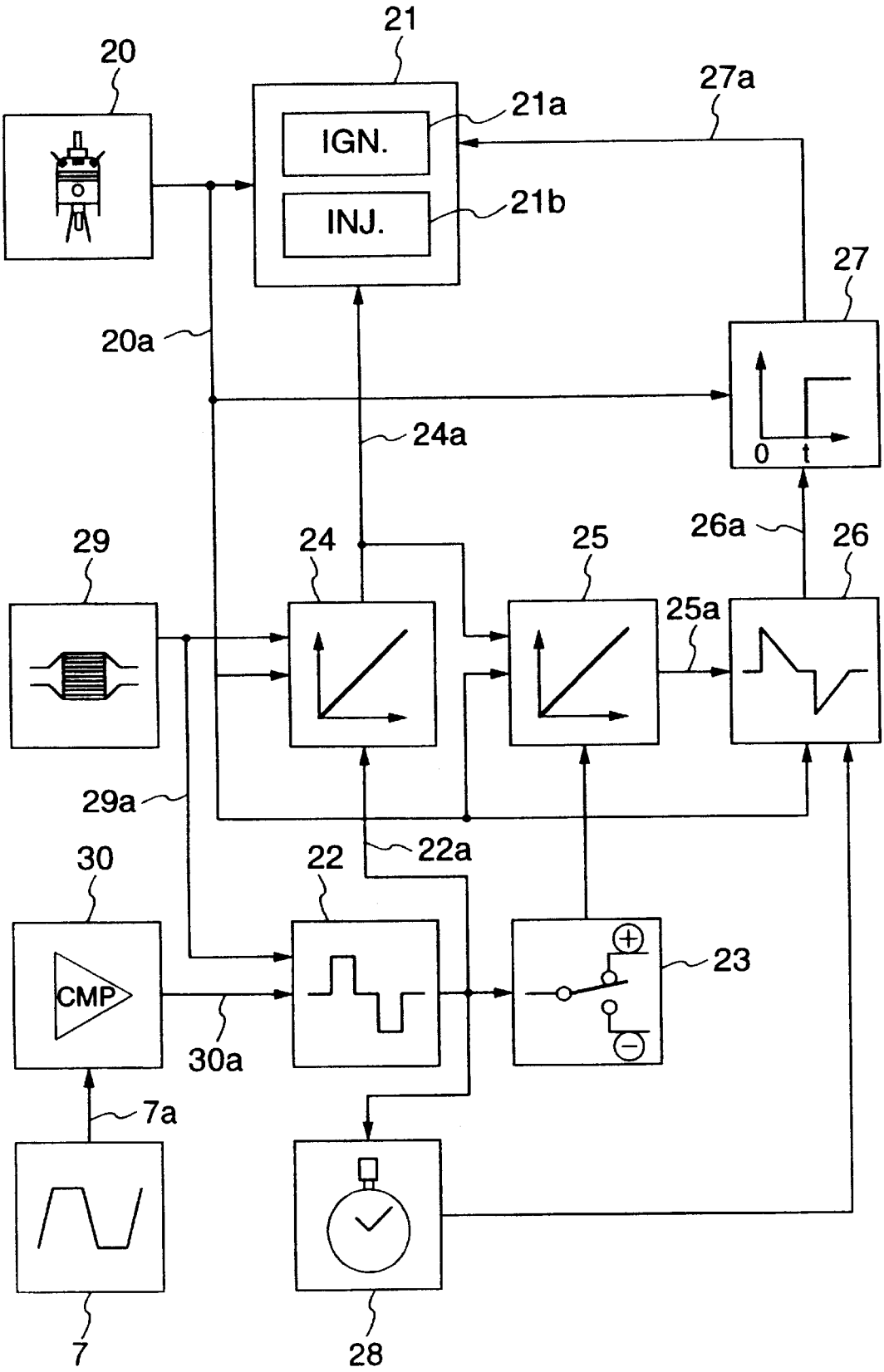
FIG. 5 is a schematic block diagram showing general function of another embodiment of the internal combustion engine control system.

While the embodiment in the case where the trigger signal is generated by the trigger signal generating means 22 per se, in FIG. 3, FIG. 5 shows another embodiment, in which the trigger signal is generated in response to an external signal.

The signal 7*a* of the air/fuel ratio sensor 7 is fed to the rich/lean judgement means 30, in which judgement of rich or lean is effected by comparing the air/fuel ratio sensor signal 7*a* with the predetermined value. On the basis of a judgement signal 30*a*, the trigger signal is generated in the trigger signal generating means 22. In this case, since the trigger signal is generated in synchronism with the air/fuel ratio sensor signal 7*a*, the air/fuel ratio control can be performed using this signal.

Needless to say, the air/fuel ratio control speed, namely, magnitudes of a proportional component P and an integral component I correspond to the amplitude of oscillation of the air/fuel ratio in the embodiment of FIG. 3. In the shown embodiment, similarly to the air/fuel ratio adjusting means 24 in the embodiment of FIG. 3, the air/fuel ratio control speed is determined on the basis of the purification performance detection information 29*a* and the operating condition indicative information 20*a*. Other construction in the shown embodiment is similar to the embodiment of FIG. 3.

Figure 6:
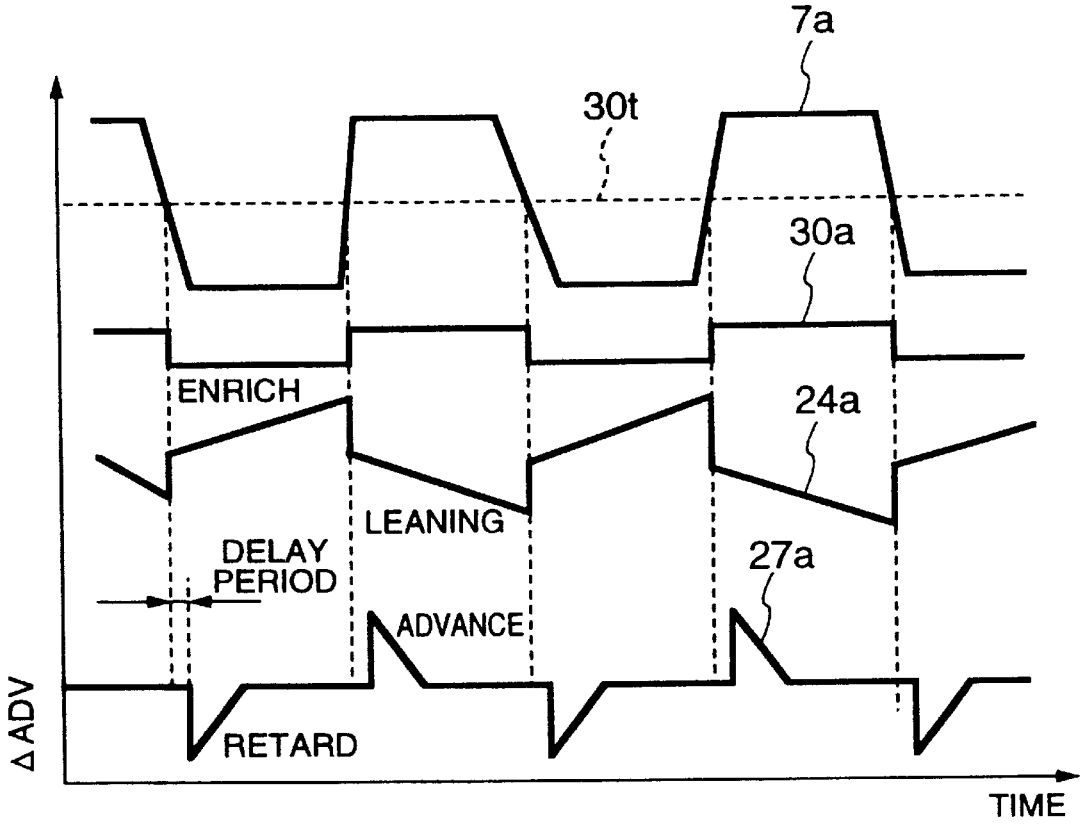
FIG. 6 is a waveform chart showing a relationship between an air/fuel ratio oscillation amplitude signal 24*a* and a spark ignition timing oscillation amplitude signal 27*a* of the internal combustion engine control system of FIG. 5.

FIG. 6 shows a relationship between the air/fuel ratio sensor signal 7*a*, the air/fuel ratio amplitude signal 24*a*, namely an air/fuel ratio control coefficient, and the spark ignition timing oscillation amplitude signal 27*a*.

The air/fuel ratio sensor signal 7*a* is compared with a rich/lean judgement threshold value 30*t* to make judgement as rich when the signal 7*a* is greater than the threshold value and as lean when the signal 7*a* is smaller than the threshold value. A result of judgement is output as a binary signal 30*a*. Depending upon the result of judgement, feedback control of the air/fuel ratio is performed by PI control. Upon reversal of the judgement result from rich to lean, air/fuel ratio is controlled toward rich side, wherein the P component is added, and subsequently, the I component is continuously and gradually controlled toward rich side until the judgement result is again reverse to rich, to handle as the air/fuel ratio oscillation amplitude signal 24*a* reversed from lean to rich, to perform control similarly to FIG. 3.

Figure 7:
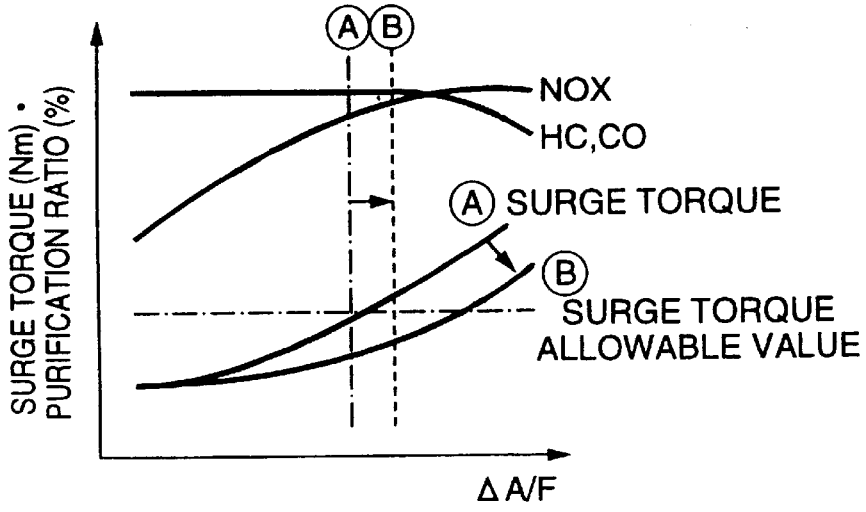
FIG. 7 is a graph showing a relationship between an air/fuel ratio oscillation amplitude (ΔA/F), a purification ratio of a catalyst and a surge torque of the internal combustion engine.

FIG. 7 shows a relationship between an air/fuel ratio oscillation amplitude (ΔA/F), the purification rate of the catalytic converter, and a relationship between the air/fuel ratio oscillation amplitude (ΔA/F) and a surge torque of the engine.

According to increasing of ΔA/F, purification ratio of the catalytic converter is improved. However, in conjunction therewith, surge torque is increased to possibly cause degradation of the drivability. In view-point of the purification ratio, (B) is the optimal ΔA/F. However, at this ΔA/F, the surge torque grows beyond the allowable value. Therefore, the ΔA/F corresponding to (B) cannot be used. For this reason, the ΔA/F corresponding to (A) is applied with compromising the purification ratio at lower ratio.

However, by providing oscillation amplitude for the spark ignition timing, degradation of the surge torque can be reduced to permit to set the ΔA/F from (A) to (B) to permit use of ΔA/F at the optimal point with capability of improving drivability.

Figure 8:
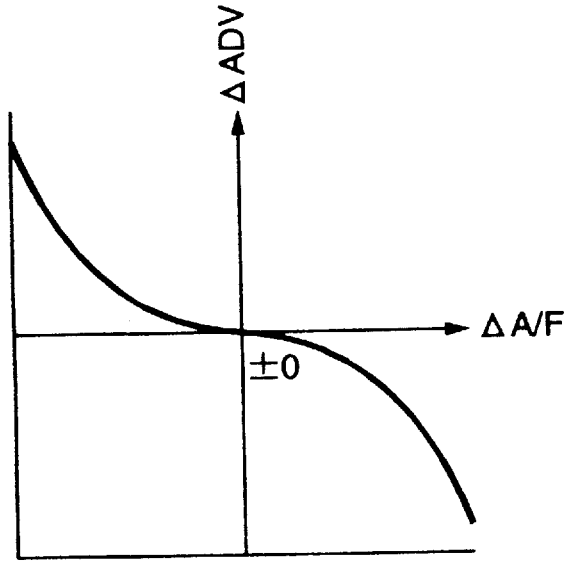
FIG. 8 is a graph showing a relationship between the air/fuel ratio oscillation amplitude (ΔA/F) and an initial value of a spark ignition timing oscillation amplitude.
Figure 9:
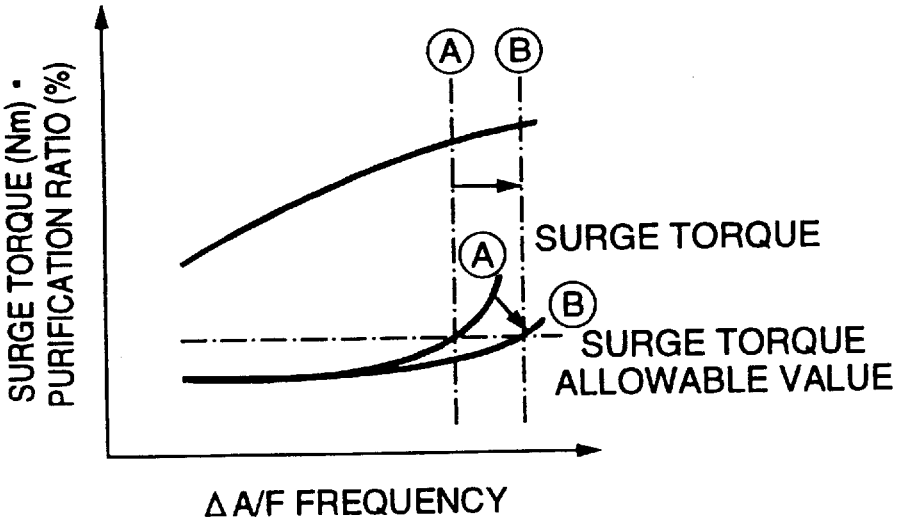
FIG. 9 is a graph showing a relationship between a ΔA/F frequency, the purification ratio of the catalytic converter and the surge torque of the internal combustion engine.

FIG. 8 shows a relationship between ΔA/F and the initial value of oscillation amplitude of the spark ignition timing.

According to growing of ΔA/F in rich side or lean side from ±0, the initial value of the oscillation amplitude of the spark ignition timing is set at greater value.

The purification ratio of the catalytic converter has a tendency to be better at higher ΔA/F frequency. Conversely, the surge torque is wholly increased in comparison with the condition where no ΔA/F is applied. On the other hand, the surge torque tends to be greater at higher ΔA/F frequency. For obtaining better purification ratio, it is desired to apply ΔA/F at higher frequency. However, in view of increasing of the surge torque, the ΔA/F frequency cannot be set higher than the frequency corresponding to (A). However, by providing oscillation amplitude of the spark ignition timing as set forth above, increasing of the surge torque can be suppressed to permit increase of the frequency of the ΔA/F from the frequency corresponding to (A) to the frequency corresponding to (B). Thus, the frequency of the ΔA/F can be set at optimal range and drivability can also be improved.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

As can be appreciated from the discussion given hereabove, the control system for the internal combustion engine according to the present invention determines the oscillation amplitude of the air/fuel ratio of the mixture to be supplied to the internal combustion engine on the basis of the catalytic converter purification performance detecting information, the operating condition information from the engine operating condition detecting means, and varies the spark ignition timing on the basis of oscillation amplitude of the air/fuel ratio and the operating condition of the internal combustion engine to achieve maximization of purification ratio of the catalytic converter with avoidance of degradation of drivability.

What is claimed is:

1. An internal combustion engine control system, comprising:

a catalytic converter for purifying an exhaust gas of an internal combustion engine internal combustion engine operating condition detecting means for detecting operating condition of said internal combustion engine;

internal combustion engine control means for controlling one of an air/fuel ratio of an air/fuel mixture to be supplied to said internal combustion engine and a delivered engine torque of the internal combustion engine depending upon the operating condition;

trigger signal generating means for generating a trigger signal for varying the air/fuel ratio toward rich side or lean side;

air/fuel ratio adjusting means responsive to said trigger signal for varying said air/fuel ratio toward rich side or lean side;

said delivered engine torque being corrected on the basis of said trigger signal, and purification performance detecting means for detecting current condition of an exhaust gas purification performance of said catalytic converter, and an amplitude of said air/fuel ratio by said air/fuel ratio adjusting means is varied such that one of surge torque of said internal combustion engine is less than a predetermined value and the purification performance exceeds a predetermined performance value.

2. An internal combustion engine control system as set forth in claim 1, which comprises:

an air/fuel ratio sensor provided upstream of the catalytic converter and detecting said air/fuel ration from an exhaust gas component;

air/fuel ratio control means for controlling the air/fuel ratio of said air/fuel mixture to be supplied to said internal combustion engine toward a target value depending upon an output signal of said air/fuel ratio sensor;

rich/lean judgement means for comparing the air/fuel ratio of the supplied air/fuel mixture with a predetermined value and making judgement whether the air/fuel ratio of the supplied air/fuel mixture is rich or lean;

said trigger signal is generated when the result of judgement is reversed from rich to lean or from lean to rich, and which further comprises torque correcting direction determining means for determining torque correcting direction for increasing said delivered torque with respect to said trigger signal when the result of judgement is reversed from rich to lean and for reducing said delivered torque with respect to said trigger signal when the result of judgement is reversed from lean to rich, said torque correction is performed in the direction based on the result of said determination.

3. An internal combustion engine control system according to claim 1, wherein said correction of delivered engine torque of said internal combustion engine is performed by adjusting one of a spark ignition timing, a fuel injection timing, an EGR flow rate, an intake air flow rate, an intake air flow strength, a fuel particle diameter, an intake or exhaust valve timing, an intake valve lift, an induction passage length and an engine load.

4. An internal combustion engine control system, comprising a catalytic converter for purifying an exhaust gas of an internal combustion engine internal combustion engine operating condition detecting means for detecting operating condition of said internal combustion engine;

internal combustion engine control means for controlling one of an air/fuel ratio of an air/fuel mixture to be supplied to said internal combustion engine and a delivered engine torque of the internal combustion engine depending upon the operating condition;

trigger signal generating means for generating a trigger signal for varying the air/fuel ratio toward rich side or lean side;

air/fuel ratio adjusting means responsive to said trigger signal for varying said air/fuel ratio toward rich side or lean side;

said delivered engine torque being corrected on the basis of said trigger signal, and, wherein said trigger signal is generated per every given time interval, and which further comprises torque correcting direction determining means for determining a correcting direction of torque to reduce said delivered engine torque when said air/fuel ratio is to be varied toward rich side and to increase said delivered engine torque when said air/fuel ratio is to be varied toward lean side for performing torque correction in a direction based on the result of determination, and a generation time interval of said trigger signal is variable such that one of a surge torque of said internal combustion engine is below a predetermined torque value and a purification performance of said catalytic converter exceeds a predetermined performance value.

5. An internal combustion engine control system according to claim 4, wherein said correction of delivered engine torque of said internal combustion engine is performed by adjusting one of a spark ignition timing, a fuel injection timing, an EGR flow rate, an intake air flow rate, an intake air flow strength, a fuel particle diameter, an intake or exhaust valve timing, an intake valve lift, an induction passage length and an engine load.

6. An internal combustion engine control system, comprising:

a catalytic converter for purifying an exhaust gas of an internal combustion engine internal combustion engine operating condition detecting means for detecting operating condition of said internal combustion engine;

internal combustion engine control means for controlling one of an air/fuel ratio of an air/fuel mixture to be supplied to said internal combustion engine and a delivered engine torque of the internal combustion engine depending upon the operating condition;

trigger signal generating means for generating a trigger signal for varying the air/fuel ratio toward rich side or lean side;

air/fuel ratio adjusting means responsive to said trigger signal for varying said air/fuel ratio toward rich side or lean side;

said delivered engine torque being corrected on the basis of said trigger signal, torque correcting amount determining means for determining a torque correcting amount on the basis of one of the operating condition of said internal combustion engine and an air/fuel ratio variation amplitude by said air/fuel ratio adjusting means, the torque correction amount in said torque correction being variable depending upon the determination, and a torque correction amount control means being applied to the torque correcting amount determined by said torque correcting amount determining means as an initial value of a torque correction amount at an initial stage of generation of said trigger signal, for subsequently controlling said torque correcting amount so that it is gradually reduce, and said torque correction is performed on the basis of the subsequent control.

7. An internal combustion engine control system as set forth in claim 6, which further comprises trigger signal interval measuring means for measuring an interval of generation of said trigger signals, and a reduction speed of the correction amount of said torque correction is variable depending upon one of the operating condition of said internal combustion engine and the generation interval of said trigger signal measured by said trigger signal interval measuring means.

8. An internal combustion engine control system according to claim 6, wherein said correction of delivered engine torque of said internal combustion engine is performed by adjusting one of a spark ignition timing, a fuel injection timing, an EGR flow rate, an intake air flow rate, an intake air flow strength, a fuel particle diameter, an intake or exhaust valve timing, an intake valve lift, an induction passage length and an engine load.

9. An internal combustion engine control system, comprising:

a catalytic converter for purifying an exhaust gas of an internal combustion engine internal combustion engine operating condition detecting means for detecting operating condition of said internal combustion engine;

internal combustion engine control means for controlling one of an air/fuel ratio of an air/fuel mixture to be supplied to said internal combustion engine and a delivered engine torque of the internal combustion engine depending upon the operating condition;

trigger signal generating means for generating a trigger signal for varying the air/fuel ratio toward rich side or lean side;

air/fuel ratio adjusting means responsive to said trigger signal for varying said air/fuel ratio toward rich side or lean side;

said delivered engine torque being corrected on the basis of said trigger signal, and a delay period setting means for setting a predetermined delay period from said trigger signal to initiation of said torque correction, and said torque correction is initiated on the basis of the delay period said by said delay period setting means.

10. An internal combustion engine control system as set forth in claim 9, wherein said delay period is variable depending upon the operating condition of said internal combustion engine.

11. An internal combustion engine control system according to claim 9, wherein said correction of delivered engine torque of said internal combustion engine is performed by adjusting one of a spark ignition timing, a fuel injection timing, an EGR flow rate, an intake air flow rate, an intake air flow strength, a fuel particle diameter, an intake or exhaust valve timing, an intake valve lift, an induction passage length and an engine load.

* * * * *